US006002197A

United States Patent [19]

Tanaka et al.

[11] Patent Number: 6,002,197

[45] Date of Patent: Dec. 14, 1999

[54] METAL HALIDE LAMP LIGHT SOURCE DEVICE HAVING CONDUCTING WIRE POSITIONED TO PREVENT IT FROM CASTING A SHADOW

[75] Inventors: Yasuo Tanaka; Kiyoyuki Kabuki; Tadatoshi Higashi, all of Himeji; Tomoyoshi Arimoto, Tatsuno, all of Japan

[73] Assignee: Ushiodenki Kabushiki Kaisha, Tokyo, Japan

[21] Appl. No.: 08/840,067

[22] Filed: Apr. 24, 1997

[30] Foreign Application Priority Data

Apr. 24, 1996 [JP] Japan ..... 8-126328
Jun. 4, 1996 [JP] Japan ..... 8-162511

[51] Int. Cl.[6] ..... H01J 5/16

[52] U.S. Cl. ..... 313/113; 313/570

[58] Field of Search ..... 313/113, 114; 362/263

[56] References Cited

U.S. PATENT DOCUMENTS 4,510,558 4/1985 Van Den Brink ..... 362/263
5,479,065 12/1995 Sugimoto et al. ..... 313/113
5,574,328 11/1996 Okuchi ..... 313/114
5,789,850 8/1998 Iwafuji et al. ..... 313/318.08
5,806,971 9/1998 Sugihara et al. ..... 362/264

*Primary Examiner*—Vip Patel
*Assistant Examiner*—Matthew Gerike
*Attorney, Agent, or Firm*—Sixbey, Friedman, Leedom & Ferguson; David S. Safran

[57] ABSTRACT

A light source device for a liquid crystal projector in which it is possible to prevent distinct appearance of a shadow of the conducting wiring of a lamp on a screen, even if an integrator lens is used, is achieved according to the invention by the fact that, in a light source device which has a metal halide lamp with bilateral sealed terminations in which seal areas are joined in one piece to two ends of an arc tube, and a concave reflector, in which one of the seal areas of the lamp is installed and held in a base opening of the concave reflector, and in which the other seal area extends in toward the front opening of the concave reflector, by conducting wiring connected to the outer lead pin which projects from the seal area toward the front opening of the concave reflector being positioned running toward the arc tube in a manner resting directly on this seal area, and then being drawn out in the vicinity of the arc tube with to behind the concave reflector.

7 Claims, 6 Drawing Sheets

METAL HALIDE LAMP LIGHT SOURCE DEVICE HAVING CONDUCTING WIRE POSITIONED TO PREVENT IT FROM CASTING A SHADOW

BACKGROUND OF THE INVENTION

1. Field of the Invention

The invention relates to a light source device for a liquid crystal projector in which a short arc metal halide lamp with bilateral sealed terminations is used for a light source.

2. Description of Related Art

In a short arc metal halide lamp with bilateral sealed terminations, at least one metal halide is encapsulated as the emission metal in an arc tube which is made of quartz glass and in which a pair of electrodes is located, at a distance of roughly a few millimeters from one another, together with mercury and a starting rare gas. Seal areas are joined in one piece to the two ends of the arc tube. In the respective seal area, a molybdenum foil is inserted, to the ends of which an electrode and one end of an outer lead pin are welded for purposes of power supply. Thus, the outer lead pin projects out of the respective seal area.

In a metal halide lamp of this type, as a result of the vaporization of the metal halide due to heating, a vapor pressure which is lower than in the case of using at least one metal element is obtained to a sufficient degree. In this case, the radiant efficiency is higher than in a high-pressure mercury lamp. In addition, by suitable selection of the metal to be encapsulated, outstanding color reproduction is obtained. Therefore, a metal halide lamp is often used for a light source device for a liquid crystal projector.

A light source device for a liquid crystal projector comprises, as is shown in FIGS. 8 and 9, a short arc metal halide lamp 10 with bilateral sealed terminations, as mentioned above, and a concave reflector 20 which has base opening 21 in the middle area. Metal halide lamp 10 is held securely in the state in which the axis of metal halide lamp 10 and the optical axis of concave reflector 20 roughly agree with one another, such that seal area 12 of metal halide lamp 10 is installed in base opening 21 by embedding using a filler material or by similar methods. The other seal area 13 of metal halide lamp 10, therefore, extends in the direction to front opening 22 of concave reflector 20. Outer lead pin 15, to which one end of conducting wiring 30 is connected, projects out of this seal area 13.

The conducting wiring 30 connected to projecting outer lead pin 15 is first withdrawn in the vertical/radial direction and then parallel to metal halide lamp 10, then passes through base opening 21 of concave reflector 20 and is drawn out to behind concave reflector 20, as is shown in FIG. 8. Alternatively, conducting wiring 30 is withdrawn from the end of seal area 13 in a large arc, and then passes through a through opening 24 which is formed on reflection surface 23 of concave reflector 20 is drawn out to behind concave reflector 20, as is shown in FIG. 9. This means that the conducting wiring 30 is withdrawn, in any case, from the end of seal area 13 of the metal halide lamp 10 and is in a state in which it is spaced very far from seal area 13 and from arc tube 11.

In a liquid crystal projector device, as is illustrated in FIG. 10, parallel light which has been reflected by concave reflector 20 passes through a condenser lens 51 and is incident on a liquid crystal cell 60, with an image which is displayed on a screen (not shown) by projection lens 52. Recently however, a liquid crystal projector device is being used more and more frequently in which an integrator lens 40 is provided between the concave reflector 20 of the light source device and the condenser lens 51 in order to make the distribution of illumination intensity as uniform as possible on the screen. Integrator lens 40 has a pair of lenses, i.e., an incidence side lens 41 and an exit side lens 42, in which several lens elements arranged flat. Furthermore, besides the above described components, if necessary, there are also parts such as a color filter and a polarization element and the like.

In an integrator optics system, the lens elements of the incidence side lens 41 are imaged by means of the exit side lens 42 on liquid crystal cell 60. For the light which emerges from this integrator lens 40, the distributions of the illumination intensity of the light which has emerged from several lens elements which form the integrator lens 40 are therefore added. This means that, in doing so, a distribution curve of illumination intensity is formed in which the mildly curved distribution curves of the illumination intensity of the exit light have been assembled by small phase differences from one another. Thus, the distribution curve of illumination intensity achieves a roughly flat shape. Therefore, the illumination intensity on the screen can be made roughly uniform.

The incidence side lens is also called a second light source, because the lens elements of the lens on the incidence side are imaged in this way by the exit side lens on the liquid crystal cell. Therefore, if there is a body in the vicinity of the lens on the incidence side as a second light source, its picture is imaged on the liquid crystal cell and therefore appears as a shadow on the screen, the shadow becoming more distinct, the smaller the distance between the body and the lens on the incidence side.

In a liquid crystal projector device, as a result of the requirement for reducing the size of the device, the design is also made such that the distance between the light source device and the lens on the incidence side of the integrator lens is a small as possible. The distance between the tip of the front opening of the concave reflector and the lens on the incidence side of the integrator lens is roughly 20 mm. Furthermore, the distance between the area in which the conducting wiring is removed and the lens on the incidence side is roughly 10 mm, since the conducting wiring connected to the outer lead pin proceeds from the end of the seal area, the outer lead pin projecting out of the seal area which extends in the direction to the front opening of the concave reflector as was described above. This means that this distance is extremely small. Therefore, the disadvantage arises that the shadow of this conducting wiring appears clearly on the screen.

Therefore, if the length of the seal area of the metal halide lamp is reduced, the distance between the conducting wiring and the lens on the incidence surface is greater, and the shadow on the screen becomes weak.

In a metal halide lamp in which the tube wall load is great and which reaches an extremely high temperature during luminous operation, when the length of the seal area decreases, however, the molybdenum foil inserted in the seal area is exposed to high temperature oxidation; this shortens the service life of the lamp. Attenuation of the shadow by reducing the length of the seal area is therefore limited.

Furthermore, for a metal halide lamp of the short arc type, a trigger electrode is ordinarily used as the outer auxiliary electrode to improve the starting characteristic. Between the arc tube of the metal halide lamp and the concave reflector there are, therefore, two wires, that is, the conducting wiring and the trigger electrode. However, here, the disadvantages arose that these two wires hinder the light incident from the metal halide lamp on the concave reflector and that the degree of utilization of the light decreases. Furthermore, there was the disadvantage that production of the trigger electrode is very costly.

Additionally, it is considered a disadvantage that, when using a liquid crystal projector as the light source device, the shadow of the conducting wiring is displayed on the screen because the conducting wiring which is withdrawn at a great distance from the arc tube is in a position which is nearer the integrator lens.

SUMMARY OF THE INVENTION

Therefore, a primary object of the present invention is to devise a light source device in which it is possible to prevent clear appearance of a shadow of the conducting wiring of a metal halide lamp on the screen, even if an integrator lens is used to make the distribution of the illumination intensity on the screen uniform.

The another primary object of the invention is to devise a metal halide lamp light source device in which not only the shadow of the conducting wiring, but also the shadow of a trigger electrode, are not easily displayed on the screen, in which the trigger electrode can also be easily produced, and in which the cost can be reduced.

The above described objects and others are achieved, according to preferred embodiments of the invention, in a light source device which has a short arc metal halide lamp in which seal areas are joined in one piece to the two ends of a quartz glass arc tube, in which there is a pair of electrodes, and in which together with mercury and the starting rare gas at least one metal halide is encapsed, in which outer lead pins project from the above described seal areas, in which a concave reflector is provided with a base opening in its middle area, in which one of the seal areas is installed in the base opening in the state in which the lamp axis and the optical axis of the concave reflector approximately agree with one another, and in which the other seal area extends in the direction to the front opening of the concave reflector, by there being conducting wiring connected to the outer lead pin which projects from the seal area which extends in the direction to the front opening of the concave reflector positioned in the direction to the arc tube in a manner in which it rests along this seal area and directly against it, and by its being drawn out in the vicinity of the arc tube with the formation of. A distance from the arc tube to behind the concave reflector.

This means that, by this arrangement, the distance between the area in which the conducting wiring runs at a distance from the arc tube and the lens on the incidence side, the segment in which the conducting wiring runs along the seal area becomes greater than the conventional distance. The picture of the conducting wiring imaged by the lens on the exit side of the integrator lens is, therefore, largely withdrawn from the liquid crystal cell, and as a result thereof, the shadow of the conducting wiring on the screen becomes extremely weak.

Moreover, the objects of the invention are achieved by the above described conducting wiring being drawn out to behind the concave reflector, after it has been attached at the base point of the electrode of the seal area which is installed in the base opening of the concave reflector, and by the attachment site acting as a trigger electrode in the base point of the electrode of this seal area.

The objects of the invention are further achieved by the above described conducting wiring being attached at the base point of the electrode of the seal area which extends in the direction to the front opening of the concave reflector.

The objects of the invention are also achieved by the above described conducting wiring being attached at the base point of the electrode of the seal area which extends in the direction to the front opening of the concave reflector and by a second attachment site being formed.

This means that, by using the conducting wiring as the trigger wire as well, the arc tube of the lamp is traversed only by a single line and the degree of utlization of the light is raised accordingly. Furthermore, the trigger electrode can be produced extremely easily by the measure by which the conducting wiring is attached in the base point of the electrode of the seal area and by which this attachment site can act as a trigger electrode. Also, the conducting wiring thus approaches the arc tube more than in the conventional example by its being located along the arc tube in the state in which it rests along the seal area or as near as possible to it. In this way, the shadow of the conducting wiring does not appear strongly on the screen.

Moreover, according to the invention, the measure by which the conducting wiring is also attached in the base point of the electrode of the seal area which extends in the direction to the front opening of the concave reflector, and by which the electrical potential of this electrode is made identical to the electrical potential of the surface of the seal area, prevents the positive ions, which are contained in atmospheric impurities located on the surface of this signal area, from being attracted by the cathode when this electrode is a cathode. In this way, formation of holes in the seal area can be prevented.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
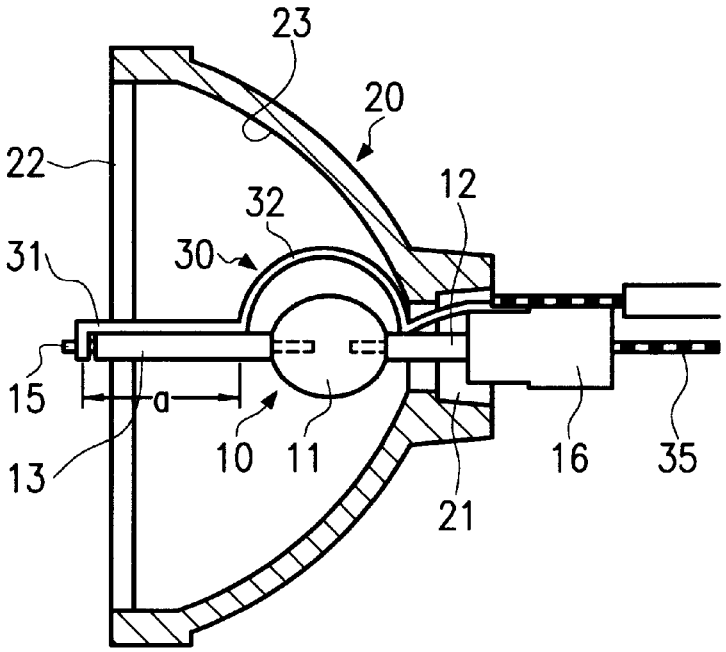
FIG. 1 shows a cross section of a first embodiment of the invention.

In FIG. 1, a short-arc metal halide lamp 10, with bilateral sealed terminations, comprises a quartz glass arc tube 11 and seal areas 12, 13 which are joined to the opposite ends of arc tube 11. Within arc tube 11 are a pair of electrodes which are spaced opposite each other by a distance of a few millimeters, and at least one metal halide such as Dy, Nd, Lu, Cs and the like, encapsulated together with mercury and a starting rare gas. Molybdenum foils are inserted in seal areas 12, 13.

A cap 16 is installed in seal area 12. An outer lead pin (not shown) of seal area 12, to which conducting wiring 35 is connected, projects from this seal area 12. An outer lead pin 15 which is electrically connected to the electrode via the molybdenum foil and to which conducting wiring 30 is connected projects from the other seal area 13. This short arc metal halide lamp 10 is supplied with power by the conducting wiring pair 30, 35 and is operated with a rated power of 250 W.

A concave reflector 20 is provided which is an oval mirror with a front opening 22 having an inside diameter of 84 mm. The inside of this ellipsoid of rotation is used as reflection surface 23. In its middle area is base opening 21. As was described above, metal halide lamp 10 is installed and held securely by embedding seal area 12 of metal halide lamp 10 in base opening 21 using a filler material or by similar means. The other seal area 13 of metal halide lamp 10, therefore, extends in the direction toward front opening 22 of concave reflector 20. Here, the axis of the metal halide lamp 10 is brought into agreement with the optical axis of concave reflector 20, the center of the arc of metal halide lamp 10 is positioned in the focal point of concave reflector 20 and the light reflected from concave reflector 20 is converted into parallel light and emitted onto an integrator lens (not shown).

As was described above, one end of conducting wiring 30 is connected to outer lead pin 15. Conducting wiring 30 has a straight part 31 and a semi-arc-shaped part 32. Straight part 31 is in contact with seal area 13 and runs lengthwise along the seal area 13, directly on it, toward arc tube 11. The light reflected by concave reflector 20, therefore, does not strike straight part 31. Here, the length of the straight part 31 is, for example, 20 mm. The semi-arc-shaped part 32 which is hit by the light which is reflected from concave reflector 20 is located concentrically to arc tube 11, in the sense that it parallels the outer surface of tube 11, and is spaced 5 mm from arc tube 11, for example. Conducting wiring 30 comes into contact with seal area 12 and is drawn out from base opening 21 to behind concave reflector 20.

Figure 2:
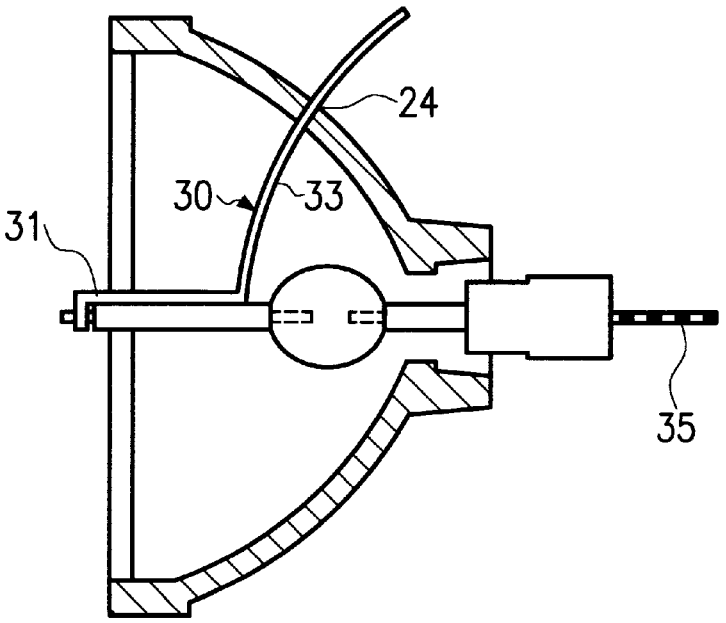
FIG. 2 shows a cross section of a second embodiment of the invention.

However, conducting wiring 30, as shown in FIG. 2, can also be formed from straight part 31 which is in contact with seal area 13, and a large arc-shaped part 33 which is spaced away from the arc tube, the conducting wiring 30 being drawn out from through an opening 24 in reflection surface 23 to behind concave reflector 20. In this case, light reflected from concave reflector 20 strikes large arc-shaped part 33, but not straight part 31.

Figure 10:
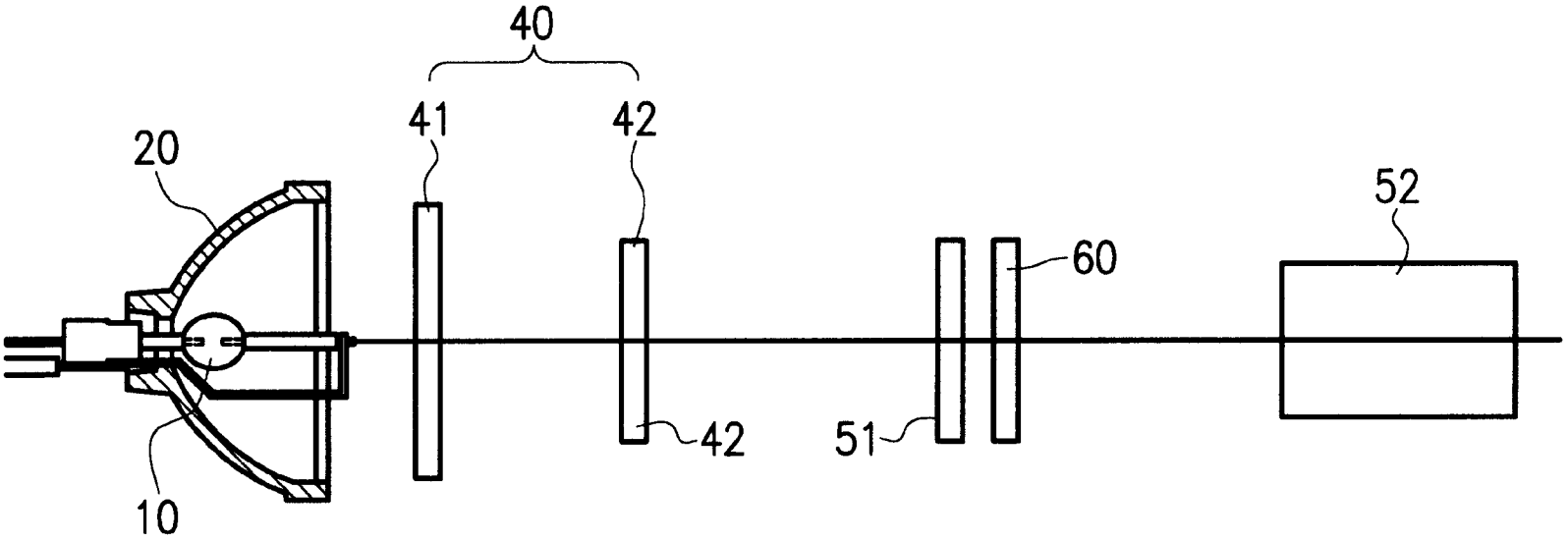
FIG. 10 shows a schematic of a liquid crystal projector device.

The semi-arc-shaped part 32 or large arc-shaped part 33 of the conducting wiring 30 which is hit by the light which is reflected by concave reflector 20 is, in this way, shifted from the end of seal area 13 toward the arc tube 11 by a distance a corresponding to the length of straight part 31. The distance between semi-arc-shaped part 32 of conducting wiring 30 or large arc-shaped part 33 thereof and lens element 41 on the incidence side of integrator lens 40 (FIG. 10), therefore, becomes larger than the conventional distance by length a. The picture of conducting wiring 30 imaged by an exit side lens element 42 of integrator lens 40 is, therefore, considerably withdrawn from liquid crystal cell 60, and as a result thereof, the shadow of conducting wiring 30 on the screen is extremely weak.

Figure 3:
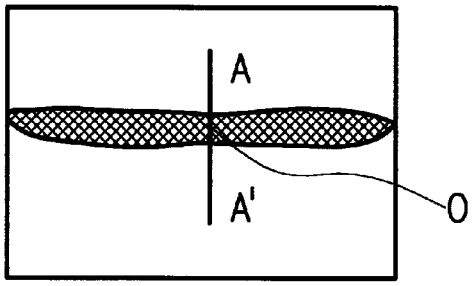
FIG. 3 shows a schematic of a shadow on the screen.
Figure 4:
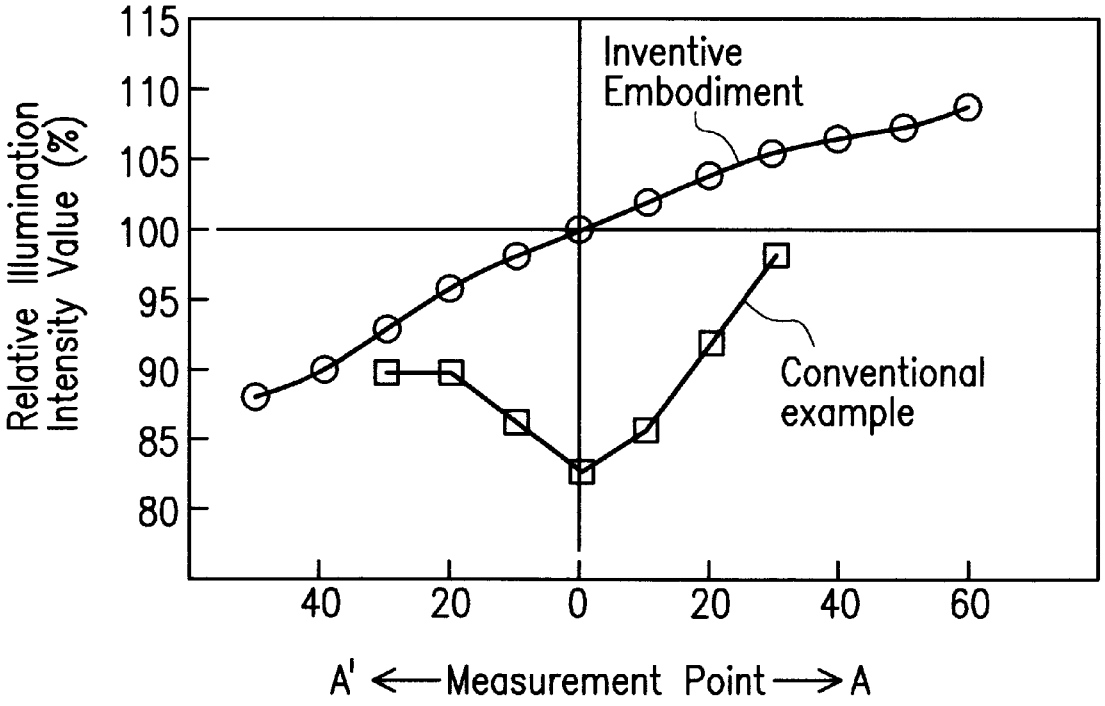
FIG. 4 graphically depicts the distributions of the illumination intensity in a shadow area on the screen.
Figure 8:
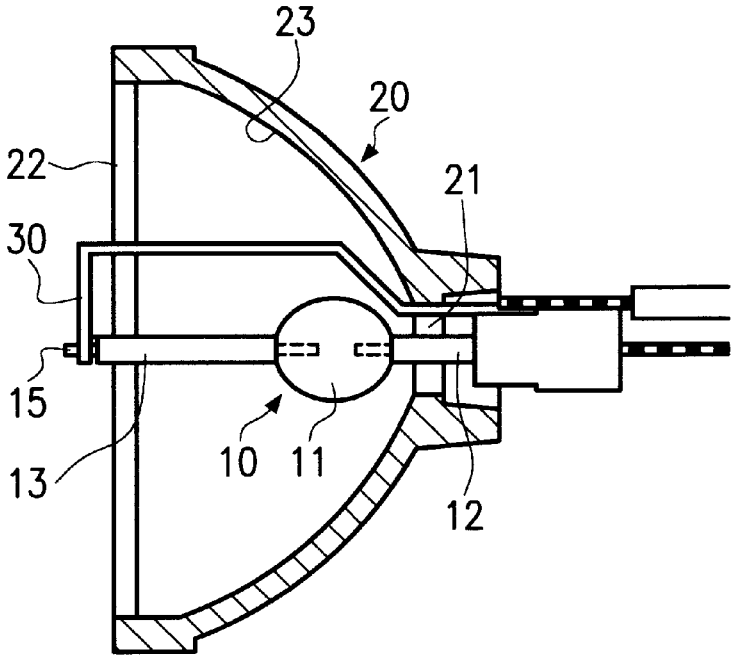
FIG. 8 shows a schematic cross section of a conventional example.
Figure 9:
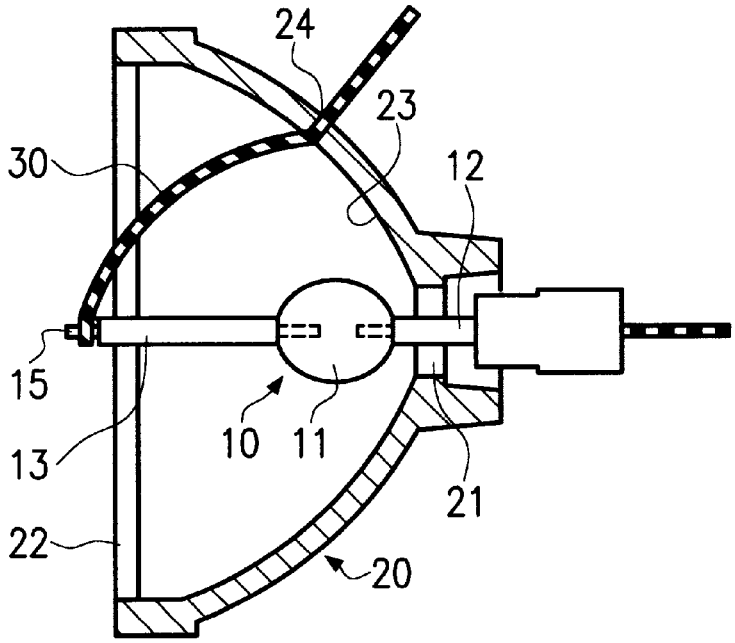
FIG. 9 shows a schematic cross section of another conventional example.

In the following, the results of measurements are described in which the distributions of illumination intensity were in fact measured in the shadow area of the conducting wiring on the screen. The light source device used for this purpose is the one shown in FIG. 1. The distance between the tip of seal area 13 and the incidence side lens element 41 of integrator lens 40 is 10 mm and the length a is 20 mm. For a conventional example, furthermore, the light source device shown in FIG. 8 is used. The black part in FIG. 3 shows the shadow of the conducting wiring on the screen. The illumination intensity was measured in direction A'–A, and the center of the shadow was designated measurement point 0. FIG. 4 shows the result. The illumination intensity is shown using relative values, the illumination intensity having been designated 100 at measurement point 0 in this embodiment.

As this clearly shows, the distribution curve of the illumination intensity in the conventional example has a trough, the illumination intensity at measurement point 0 as the center of the shadow of the conducting wiring being the lowest. This shows that the shadow of the conducting wiring appears distinctly. The distribution curve of the illumination intensity in the embodiment according to the invention is, conversely, roughly linear. This evidences that hardly any shadow of the conducting wiring can be recognized on the screen.

Figure 5:
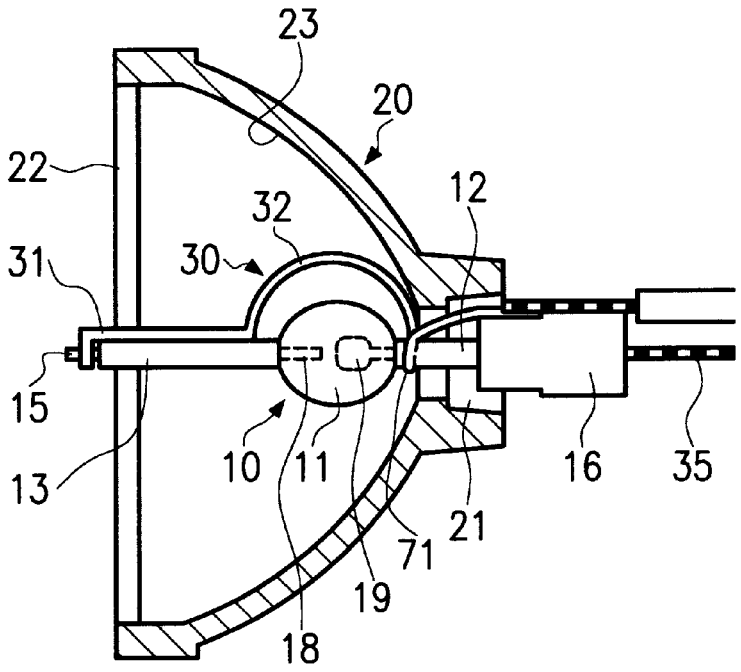
FIG. 5 shows a cross section of a third embodiment of the invention.

FIG. 5 shows a specific example in which conducting wiring 30 acts as a trigger wire. As in FIG. 1, the metal halide lamp 10 of the short arc type is installed in concave reflector 20. In this embodiment, lamp 10 is of the luminous type using a direct current. Cathode 18 is installed on the side of the front opening of concave reflector 20 and anode 19 is mounted on the side of the base opening of concave reflector 20. In this figure, the same reference numbers as in FIG. 1 have been used to label the same parts as in FIG. 1.

Figure 6:
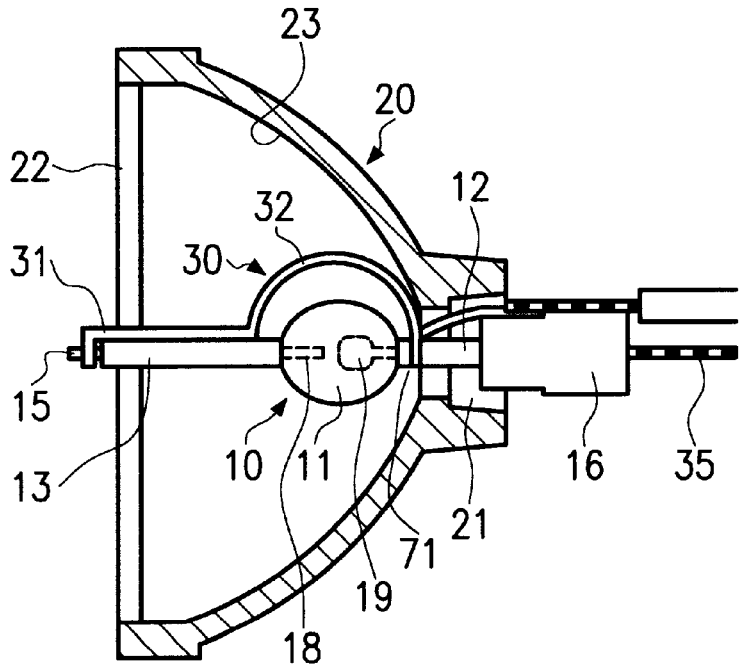
FIG. 6 shows a cross section of a fourth embodiment of the invention.

In this case, a separate wire, e.g., a wire made of an iron-chromium alloy, is wound by one turn around a base point of the electrode of seal area 12, and in this manner the conducting wiring 30 is attached at the base point of the electrode of the seal area 12. This wire forms attachment side 71. However, seal area 12 can be wound with one turn of the conducting wiring 30 itself, as is shown in FIG. 6, the conducting wiring 30 thus being attached in seal area 12 without using the addition wire. In this case, the site which is wound with conducting wiring 30 forms attachment site 71.

The manner of attachment, via an additional wire (FIG. 5) or by the wiring 30 itself (FIG. 6), basically, depends on the thickness and rigidity of the conductive wiring 30. If conductive wiring 30 is thick and relatively stiff, it need not be secured to the seal area 12 with a single winding thereof about the seal area being sufficient to hold it in place. On the other hand, if the conductive wiring 30 is thin and flexible, it may be preferable to use a separate wire to attach it to the seal area 12 to insure that it will stay in place.

This attachment site 71 acts as a trigger electrode. This means that, as the result of the different polarities of attachment site 71, which is electrically connected to outer lead pin 15 for cathode 18, a starting discharge is induced on anode 19, when starting the lamp, through the quartz glass layer of arc tube 11 between anode 19 and attachment site 71. This starting characteristic is simplified by converting this starting discharge into the main discharge between cathode 18 and anode 19.

Figure 7:
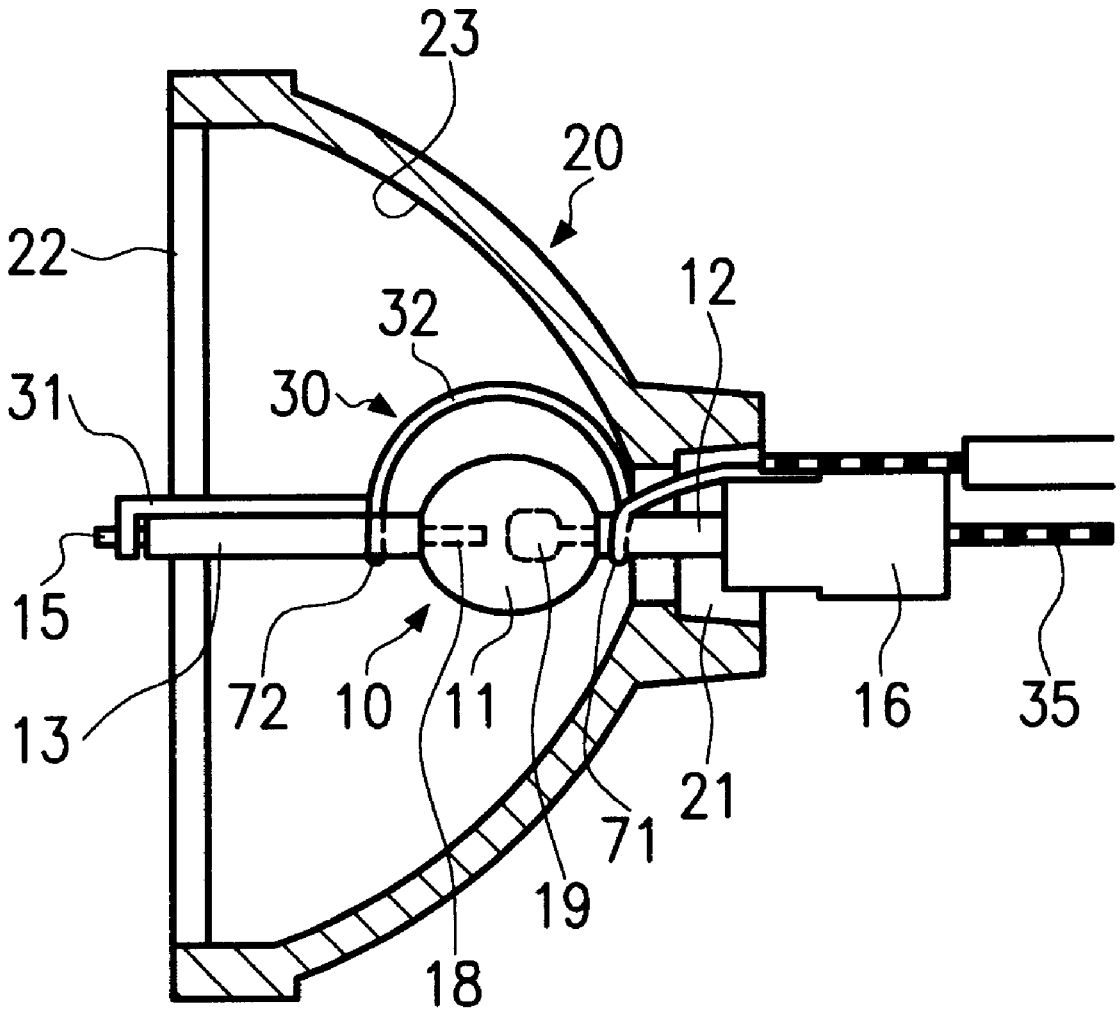
FIG. 7 shows a cross section of a fifth embodiment of the invention.

FIG. 7 shows another embodiment. Here attachment is produced not only on the base of the electrode of seal area 12, but also at the base of the electrode of seal area 13 by one turn of the wiring. In this way, a second attachment site 72 is formed. This second attachment site 72 has the same electrical potential as the cathode 18. Therefore, it does not act as a trigger electrode, but makes the electrical potential of the surface of seal area 13 the same as the electrical potential of the cathode 18 and prevents positive ions, such as sodium ions, potassium ions and the like, which are contained in atmospheric impurities found on the surface of seal area 13, from being attracted by the cathode 18. In this way, holes which are formed by passage of the positive ions through the quartz glass can be prevented.

Arc tube 11 of lamp 10 is traversed by only a single wire, i.e., conducting wiring 30, and the degree of light utilization is accordingly increased by the above described measure by which conducting wiring 30 is attached in the base point of the electrode of seal area 12 and by which this attachment site 71 acts as a trigger electrode.

Furthermore, by attaching conducting wiring 30 in the base point of the electrode of seal area 12, a trigger electrode can be easily obtained. In this way, the trigger electrode can be extremely easily produced; this can reduce costs. Furthermore, conducting wiring 30 approaches arc tube 11 by its being in a state on which it lies along seal area 13, directly on it, and by its being located in the lengthwise direction of the arc tube 11. As a result, the conducting wiring 30 is removed from the integrator lens, the shadow of the conducting wiring 30 on the screen becomes extremely weak.

Action of the Invention

As was described above, a light source device for a liquid crystal projector can be obtained in which the appearance of a shadow of the conducting wiring of the metal halide lamp on the screen can be prevented even when an integrator lens is used to make the distribution of the illumination intensity of the screen roughly uniform, by the measure according to the invention by which the conducting wiring which is connected to the outer lead pin, which projects from the seal area which extends toward the front opening of the concave reflector, runs in the lengthwise direction of the arc tube resting directly against this seal area, and by which the conducting wiring is spaced away from the arc tube only in its vicinity and is drawn out to behind the concave reflector.

Furthermore, the measure according to the invention by which the conducting wiring is attached at the base of the electrode of the seal area which is installed in the base opening of the concave reflector and by which this attachment site acts as a trigger electrode increases the degree of utilization of the light and essentially prevents a shadow of the conducting wiring on the screen. Additionally, the trigger electrode can be easily produced and a metal halide lamp light source device obtained in which the cost can be reduced.

Still further, the measure according to the invention by which the conducting wiring is attached at the base of the electrode of the seal area which extends in the direction to the front opening of the concave reflector prevents holes from being formed in the seal area, and prevents positive ions, which are contained in atmospheric impurities located on the surface of this seal area, from being attracted by the cathode.

It is to be understood that although preferred embodiments of the invention have been described, various other embodiments and variations may occur to those skilled in the art. Any such other embodiments and variations which fall within the scope and spirit of the present invention are intended to be covered by the following claims.

What we claim is:

1. Metal halide lamp light source device having a short arc metal halide lamp, and a concave reflector with a front opening and with a base opening in a middle area of the reflector, in which the lamp has two seal areas, each seal area being joined in one piece to a respective one of two opposite ends of a quartz glass arc tube in which a pair of electrodes, mercury, a starting rare gas, and at least one metal halide are encapsulated, and outer lead pins project which from the seal areas, a first of the two seal areas being installed in the base opening of the reflector with a longitudinal axis of the lamp and an optical axis of the concave reflector in approximate agreement with one another, and with a second of the two seal areas extending in a direction toward the front opening of the concave reflector; wherein conducting wiring is connected to the outer lead pin which projects from the second of the two seal areas, said conducting wiring having a first portion which runs from the outer lead pin toward the arc tube resting directly against an outer surface of the second of the two seal areas and a second portion which is drawn out to behind the concave reflector at a distance from the arc tube.

2. Metal halide lamp light source device according to claim 1, wherein the second portion of conducting wiring is attached at an attachment site at a base of a one of the electrodes which is in the first of two seal areas before being drawn out to behind the concave reflector, and wherein the attachment site forms a trigger.

3. Metal halide lamp light source device according to claim 2, wherein the first portion of conducting wiring is attached at a second attachment site at a base of one of the electrodes which is in the second of the two seal areas.

4. Metal halide lamp light source device according to claim 3, wherein the conducting wiring is wound about the respective seal area at each of said attachment sites.

5. Metal halide lamp light source device according to claim 2, wherein the conducting wiring is wound about the first of the two seal areas at said attachment site.

6. Metal halide lamplight source device according to claim 1, wherein the first portion of conducting wiring is attached at a attachment site at a base of a one of the electrodes which is in the second of the two seal areas.

7. Metal halide lamp light source device according to claim 6, wherein the conducting wiring is wound about the second of the two seal areas at said attachment site.

* * * * *